US009607564B2

(12) United States Patent
Wen et al.

(10) Patent No.: US 9,607,564 B2
(45) Date of Patent: Mar. 28, 2017

(54) CLOCK GENERATOR CIRCUIT OF LIQUID CRYSTAL DISPLAY DEVICE AND OPERATION METHOD THEREOF

(71) Applicant: AU OPTRONICS CORP., Hsin-Chu (TW)

(72) Inventors: Chun-Kuei Wen, Hsin-Chu (TW); Yu-Ting Huang, Hsin-Chu (TW); Hung-Min Shih, Hsin-Chu (TW); Kuan-Yu Chen, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 140 days.

(21) Appl. No.: 14/592,013

(22) Filed: Jan. 8, 2015

(65) Prior Publication Data

US 2016/0125827 A1 May 5, 2016

(30) Foreign Application Priority Data

Oct. 31, 2014 (TW) ..... 103137894 A

(51) Int. Cl.
*G09G 3/36* (2006.01)

(52) U.S. Cl.
CPC ..... *G09G 3/3648* (2013.01); *G09G 3/3614* (2013.01); *G09G 3/3611* (2013.01); *G09G 2310/0248* (2013.01); *G09G 2310/08* (2013.01)

(58) Field of Classification Search
CPC ..... G09G 3/3648; G09G 3/3614; G09G 2310/08; G09G 2330/021; G09G 3/3696
See application file for complete search history.

(56) References Cited

U.S. PATENT DOCUMENTS

| | | | | |
|---|---|---|---|---|
| 6,549,186 | B1 | 4/2003 | Kwon | |
| 6,573,881 | B1 | 6/2003 | Kwon | |
| 7,956,854 | B2 | 6/2011 | Hashimoto | |
| 2009/0213982 | A1* | 8/2009 | Peng | G11C 19/28 377/79 |
| 2009/0237339 | A1* | 9/2009 | Pai | G09G 3/3614 345/90 |

(Continued)

FOREIGN PATENT DOCUMENTS

| | | |
|---|---|---|
| CN | 1276586 A | 12/2000 |
| CN | 100511399 | 11/2006 |

(Continued)

OTHER PUBLICATIONS

State Intellectual Property Office of the People's Republic of China, "Office Action", issued on May 19, 2016.

*Primary Examiner* — Andrew Sasinowski
*Assistant Examiner* — Gerald Oliver
(74) *Attorney, Agent, or Firm* — WPAT, PC; Justin King

(57) ABSTRACT

A clock generator circuit of a liquid display panel includes a charge sharing switch unit, a first capacitor, a first switch, a second switch, a third switch and a fourth switch. The charge sharing switch unit is configured to receive control signals and accordingly output a first-polarity voltage to the first capacitor. The clock generator circuit is configured to turn on the first switch, the second switch, the third switch and the fourth switch according to a specific sequence thereby outputting a clock signal. An operation method for the aforementioned clock generator circuit is also provided.

8 Claims, 14 Drawing Sheets

(56) References Cited

U.S. PATENT DOCUMENTS

| | | | | |
|---|---|---|---|---|
| 2010/0326744 | A1* | 12/2010 | Chang | G06F 3/044 178/18.06 |
| 2012/0038622 | A1 | 2/2012 | Cheng et al. | |
| 2013/0120349 | A1 | 5/2013 | Oh | |
| 2013/0135273 | A1 | 5/2013 | Lee et al. | |
| 2014/0375703 | A1* | 12/2014 | Ban | G09G 3/3688 345/691 |

FOREIGN PATENT DOCUMENTS

| | | | |
|---|---|---|---|
| CN | 101950520 | A | 1/2011 |
| CN | 103106862 | A | 5/2013 |

* cited by examiner

Frame1

| | | |
|---|---|---|
| + | − | + |
| + | − | + |
| − | + | − |
| − | + | − |
| + | − | + |
| + | − | + |

Frame2

| | | |
|---|---|---|
| − | + | − |
| − | + | − |
| + | − | + |
| + | − | + |
| − | + | − |
| − | + | − |

FIG. 3C

CLOCK GENERATOR CIRCUIT OF LIQUID CRYSTAL DISPLAY DEVICE AND OPERATION METHOD THEREOF

TECHNICAL FIELD

The present disclosure relates to a clock generator circuit, and more particularly to a clock generator circuit of liquid display device and an operation method thereof.

BACKGROUND

In recent years, liquid crystal display device is getting thin and the demand for large-sized liquid crystal display device is getting strong. Because the number of the internal circuits increases with the size of the liquid crystal display device, accordingly more electric power is consumed. For example, a general liquid crystal display device includes a clock generator circuit configured to generate the clock signals for the internal circuits. Specifically, a conventional clock generator circuit is supplied with an external electric power and converts the external power into the high and low voltage levels of the clock signals for the internal circuits. Because the liquid crystal display device has increased size, the clock generator circuit has to provide more and more clock signals; and consequentially, the clock generator circuit as well as the liquid crystal display device consumes more and more electric power. Thus, for a liquid crystal display device, it is important to develop a clock generator circuit consuming less electric power.

SUMMARY

The present disclosure provides a clock generator circuit of a liquid crystal display panel. The clock generator circuit includes a charge sharing switch unit, a first capacitor, a first switch, a second switch, a third switch and a fourth switch. The charge sharing switch unit has an output end and is electrically coupled between a plurality of data lines and a plurality of pixel units. The charge sharing switch unit is configured to receive a first control signal and output, through the output end thereof, a first-polarity voltage according to the first control signal. The first-polarity voltage is constituted by voltages of a plurality of first-polarity display data transmitted on the data lines. The first capacitor has a first end and a second end. The first end of the first capacitor is electrically coupled to the output end of the charge sharing switch unit and the second end of the first capacitor is electrically coupled to a first low voltage level. The first switch has a first end and a second end. The first end of the first switch is electrically coupled to the first end of the first capacitor and the second end of the first switch is electrically coupled to an output end of the clock generator circuit. The second switch has a first end and a second end. The first end of the second switch is electrically coupled to a high voltage level and the second end of the second switch is electrically coupled to the output end of the clock generator circuit. The third switch has a first end and a second end. The first end of the third switch is electrically coupled to the first low voltage level and the second end of the third switch is electrically coupled to the output end of the clock generator circuit. The fourth switch has a first end and a second end. The first end of the fourth switch is electrically coupled to a second low voltage level and the second end of the fourth switch is electrically coupled to the output end of the clock generator circuit.

In one embodiment, the aforementioned clock generator circuit further includes a sixth switch, a second capacitor and a seventh switch. The sixth switch has a first end and a second end. The second end of the sixth switch is electrically coupled to the output end of the clock generator circuit. The second capacitor has a first end and a second end. The first end of the second capacitor is electrically coupled to the first end of the sixth switch and the second end of the second capacitor is electrically coupled to the first low voltage level. The seventh switch is electrically coupled between the first end of the first capacitor and the output end of the charge sharing switch unit. The seventh switch has a first end and a second end. The first end of the seventh switch is electrically coupled to the output end of the charge sharing switch unit. The seventh switch is configured to have its second end electrically coupled to either the first end of the first capacitor or the first end of the second capacitor according to a polarity control signal. The charge sharing switch unit is further configured to receive a second control signal and output, through the output end thereof, a second-polarity voltage according to the second control signal. The second-polarity voltage is constituted by voltages of a plurality of second-polarity display data transmitted on the data lines.

The present disclosure further provides an operation method of a clock generator circuit of a liquid crystal display panel. The clock generator circuit includes a charge sharing switch unit, a first capacitor, a first switch, a second switch, a third switch and a fourth switch. The charge sharing switch unit is electrically coupled between a plurality of data lines and a plurality of pixel units. The charge sharing switch unit is configured to output a first-polarity voltage through an output end of the charge sharing switch unit. The first-polarity voltage is constituted by voltages of a plurality of first-polarity display data transmitted on the data lines. A first end of the first capacitor is electrically coupled to the output end of the charge sharing switch unit. The first switch is electrically coupled between a first low voltage level and an output end of the clock generator circuit. The second switch is electrically coupled between a second low voltage level and the output end of the clock generator circuit. The third switch is electrically coupled between the first end of the first capacitor and the output end of the clock generator circuit. The fourth switch is electrically coupled between a high voltage level and the output end of the clock generator circuit. The operation method includes: storing the first-polarity voltage into the first capacitor; turning on the first switch and outputting the first low voltage level to the output end of the clock generator circuit; turning on the second switch and outputting the second low voltage level to the output end of the clock generator circuit; turning on the fourth switch and outputting the high voltage level to the output end of the clock generator circuit; and turning on the first switch and outputting the first low voltage level to the output end of the clock generator circuit; wherein the third switch is turned on to output the first-polarity voltage stored in the first capacitor to the output end of the clock generator circuit after the first switch is turned on and before the second switch is turned on, or, after the second switch is turned on and before the fourth switch is turned on.

BRIEF DESCRIPTION OF THE DRAWINGS

The present disclosure will become more readily apparent to those ordinarily skilled in the art after reviewing the following detailed description and accompanying drawings, in which:

FIG. 3C is a schematic diagram illustrating the polarities of pixel units in column inversion mode;

DETAILED DESCRIPTION OF PREFERRED EMBODIMENTS

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1A:
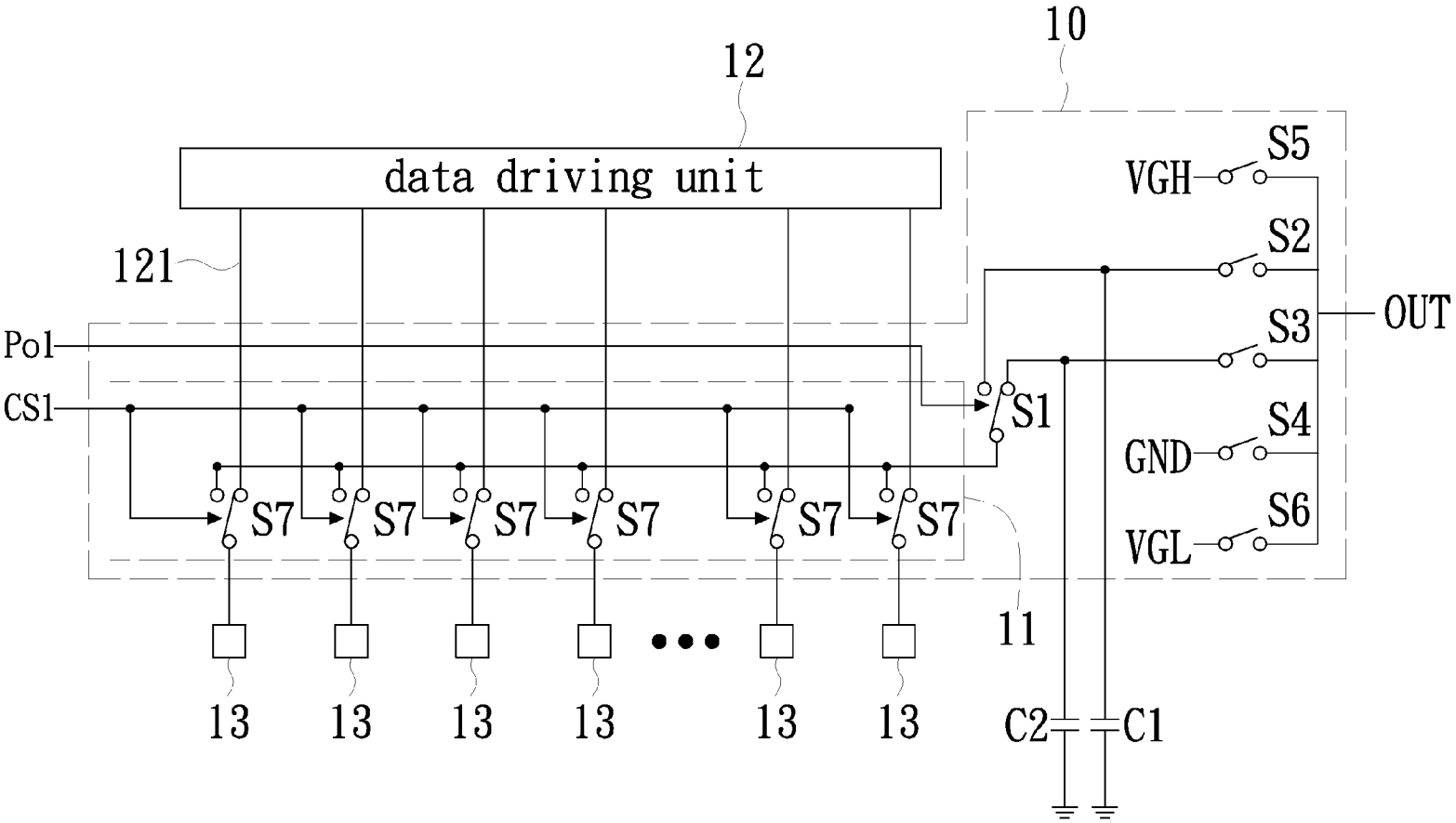
FIGS. 1A and 1B are schematic circuit block diagrams of a clock generator circuit of liquid crystal display panel in accordance with the first embodiment of the present disclosure.
Figure 1B:
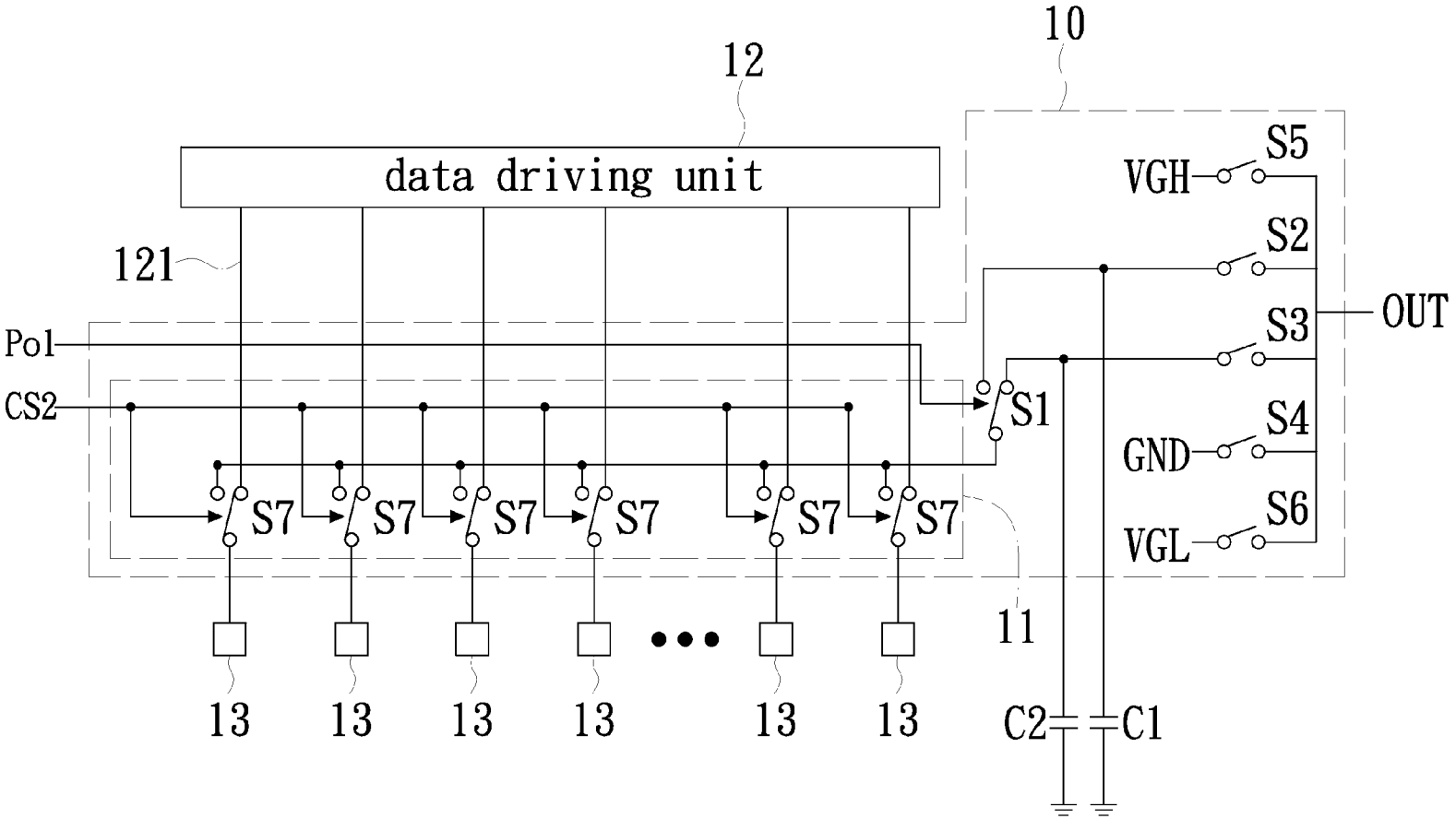
Figure 1C:
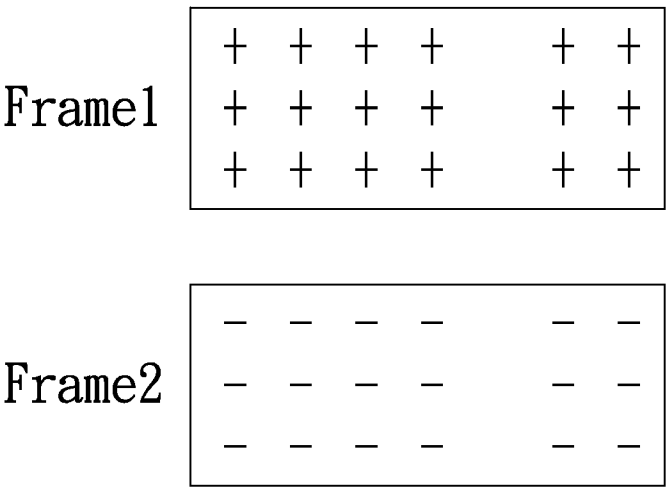
FIG. 1C is a schematic diagram illustrating the polarities of pixel units in frame inversion mode.

FIGS. 1A and 1B are schematic circuit block diagrams of a clock generator circuit of liquid crystal display panel in accordance with the first embodiment of the present disclosure. The clock generator circuit in FIGS. 1A and 1B is adapted to use with the pixel units 13 in frame inversion mode. In the frame inversion mode as illustrated in FIG. 1C, the display data of the pixel units 13 in one frame have the same polarity. For example, as illustrated in FIG. 1C, the display data of the pixel units 13 in the first frame Frame1 have positive polarity and the display data of the pixel units 13 in the second frame Frame2 have negative polarity. In other words, the display data in each successive two frames have different polarities; or, the display data of the pixel units 13 in the first frame Frame1 and the display data of the pixel units 13 in the second frame Frame2 have different polarities.

Please refer to FIG. 1A again. The clock generator circuit 10 includes a charge sharing switch unit 11. The charge sharing switch unit 11, electrically coupled to a data driving unit 12 through a plurality of data lines 121, is configured to receive a plurality of first-polarity display data outputted from the data driving unit 12. In the present embodiment, the first-polarity display data has a positive polarity. The charge sharing switch unit 11 is further electrically coupled to a plurality of pixel units 13 and is further configured to transmit the received first-polarity display data to the pixel units 13 for displaying. The charge sharing switch unit 11 is further configured to receive a first control signal CS1 and output the voltage of the first-polarity display data received by the pixel units 13 to an output end of the charge sharing switch unit 11 according to the first control signal CS1 thereby outputting the voltage of the first-polarity display data.

The charge sharing switch unit 11 includes a plurality of switches S7. Each switch S7 has a first end and a second end. In the present embodiment, the first end of each switch S7 is electrically coupled to the respective pixel unit 13. Each switch S7 is configured to have its second end electrically coupled to either the output end of the charge sharing switch unit 11 or the respective data line 12 according to the first control signal CS1 received by the charge sharing switch unit 11.

The clock generator circuit 10 further includes a switch S1. The switch S1 is electrically coupled between capacitors C1, C2 and the output end of the charge sharing switch unit 11. The switch S1 has a first end and a second end. In the present embodiment, the first end of the switch S1 is electrically coupled to the output end of the charge sharing switch unit 11. The switch S1 is configured to have its second end electrically coupled to either the capacitor C1 or the capacitor C2 according to a polarity control signal Pol thereby storing a first-polarity voltage into the capacitor C1 or storing a second-polarity voltage into the capacitor C2.

The capacitor C1 has a first end and a second end. In the present embodiment, the first end of the capacitor C1 is electrically coupled to the second end of the switch S1 and the second end of the capacitor C1 is electrically coupled to a first low voltage level GND. The capacitor C2 has a first end and a second end. In the present embodiment, the first end of the capacitor C2 is electrically coupled to the second end of the switch S1 and the second end of the capacitor C2 is electrically coupled to the first low voltage level GND.

The clock generator circuit 10 further includes a switch S2. The switch S2 has a first end and a second end. In the present embodiment, the first end of the switch S2 is electrically coupled to the first end of the capacitor C1 and the second end of the switch S2 is electrically coupled to an output end OUT of the clock generator circuit 10. The switch S2 is configured to selectively output the first-polarity voltage stored in the capacitor C1 as the first level of a clock signal CLK.

The clock generator circuit 10 further includes a switch S3. The switch S3 has a first end and a second end. In the present embodiment, the first end of the switch S3 is electrically coupled to the first end of the capacitor C2 and the second end of the switch S3 is electrically coupled to the output end OUT of the clock generator circuit 10. The switch S3 is configured to selectively output the second-polarity voltage stored in the capacitor C2 as the second level of the clock signal CLK.

The clock generator circuit 10 further includes a switch S4. The switch S4 has a first end and a second end. In the present embodiment, the first end of the switch S4 is electrically coupled to the first low voltage level GND and the second end of the switch S4 is electrically coupled to the output end OUT of the clock generator circuit 10. The switch S4 is configured to selectively output the first low voltage level GND as the first low level of the clock signal CLK.

The clock generator circuit 10 further includes a switch S5. The switch S5 has a first end and a second end. In the present embodiment, the first end of the switch S5 is electrically coupled to a high voltage level VGH and the second end of the switch S5 is electrically coupled to the output end OUT of the clock generator circuit 10. The switch S5 is configured to selectively output the high voltage level VGH as a high level of the clock signal CLK.

The clock generator circuit 10 further includes a switch S6. The switch S6 has a first end and a second end. In the present embodiment, the first end of the switch S6 is electrically coupled to a second low voltage level VGL and the second end of the switch S6 is electrically coupled to the output end OUT of the clock generator circuit 10. The switch S6 is configured to selectively output, through the output end OUT of the clock generator circuit 10, the second low voltage level VGL as a second low level of the clock signal CLK. In one embodiment, the second low voltage level VGL is lower than the first low voltage level GND.

FIG. 1B is a circuit diagram illustrating an operation of the clock generator circuit 10 when the display data of the pixel units 13 have the second polarity; wherein the second polarity is a negative polarity in one embodiment. The same label in FIGS. 1A and 1B represents the same component. The main difference between FIGS. 1A and 1B is that the switch S7 in FIG. 1B is configured to have its second end electrically coupled to either the output end of the charge sharing switch unit 11 or the respective data line 121 according to a second control signal CS2 received by the charge sharing switch unit 11.

Figure 1D:
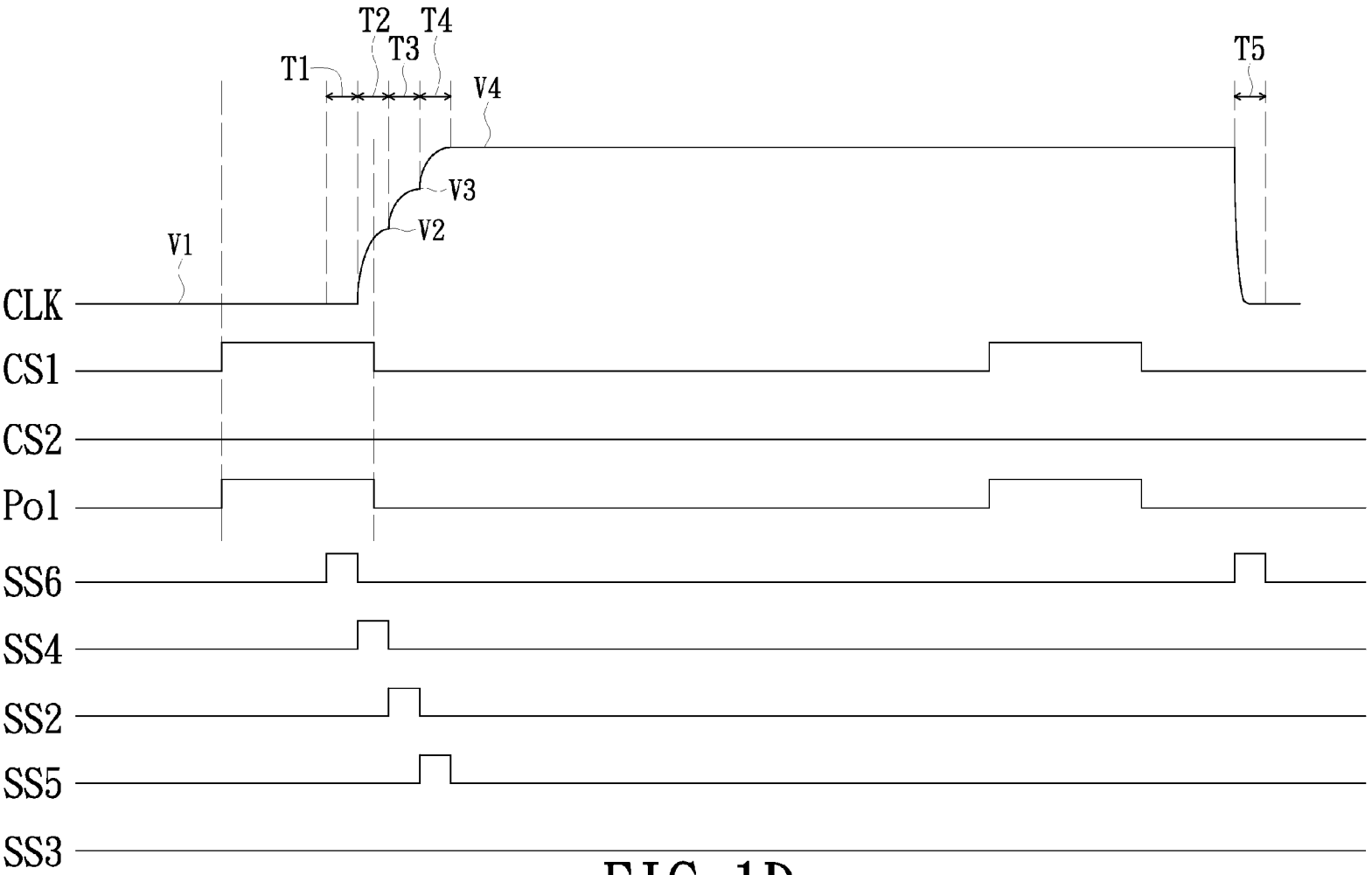
FIG. 1D is a timing chart of the related signals of the clock generator circuit in FIG. 1A.

The operation of the clock generator circuit 10 in FIG. 1A in accordance with an embodiment of the present disclosure will be described as follow with a reference of FIG. 1D, which is a timing chart of the related signals of the clock generator circuit 10 in FIG. 1A. As shown, the signals in the timing chart of FIG. 1D include the polarity control signal Pol, the first control signal CS1, the second control signal CS2, a control signal SS2 for the switch S2, a control signal SS3 for the switch S3, a control signal SS4 for the switch S4, a control signal SS5 for the switch S5 and a control signal SS6 for the switch S6. Please refer to FIGS. 1A and 1D for a better understanding of the operation of the clock generator circuit 10 in FIG. 1A. Because the pixel units 13 in FIG. 1A are in the frame inversion mode in the present embodiment, the display data of pixel units 13 in the same row have the same polarity; thus, the charge sharing of the clock generator circuit 10 for each row of pixel unit 13 can be realized by one control signal only. In the present embodiment, the polarity control signal Pol has a high voltage level when the display data of the image being displayed has the first polarity. Specifically, when the first-polarity display data are received by the pixel units 13 through the data lines 121, the first control signal CS1 has a high voltage level thereby configuring the second end of each switch S7 to switch from being electrically conductive with the respective data line 121 to being electrically conductive with the output end of the charge sharing switch unit 11. Thus, the first-polarity voltage constituted by the plurality of first-polarity display data is outputted from the output end of the charge sharing switch unit 11. Meanwhile, because the polarity control signal Pol has a high voltage level, the second end of the switch S1 is switched to being electrically conductive with the first end of the capacitor C1 according to the high-level polarity control signal Pol. Thus, before the pixel units 13 performing the charge sharing, the first-polarity voltage can be stored into the capacitor C1.

In the period before the next row of pixel unit 13 are turned on and after the first-polarity voltage is stored in the capacitor C1, the clock generator circuit 10 in FIG. 1A is configured to perform the charge sharing through the switches S2, S3, S4, S5 and S6, thereby outputting the clock signal CLK for driving the next row of pixel unit 13. Specifically, in the period T1 of the clock signal CLK, the control signal SS6 of the switch S6 has a high voltage level; thus, the switch S6 is ON and the second low voltage level VGL is outputted as the second low level of the clock signal CLK (i.e., the level V1 of the clock signal CLK in FIG. 1D). Then, in the period T2 of the clock signal CLK, the control signal SS4 of the switch S4 has a high voltage level; thus, the switch S4 is ON and the first low voltage level GND is outputted as the first low level of the clock signal CLK (i.e., the level V2 of the clock signal CLK in FIG. 1D). Then, in the period T3 of the clock signal CLK, the control signal SS2 of the switch S2 has a high voltage level; thus, the switch S2 is ON and the first-polarity voltage stored in the capacitor C1 is outputted as the first level of the clock signal CLK (i.e., the level V3 of the clock signal CLK in FIG. 1D). Then, in the period T4 of the clock signal CLK, the control signal SS5 of the switch S5 has a high voltage level; thus, the switch S5 is ON and the high voltage level VGH is outputted as the high level of the clock signal CLK (i.e., the level V4 of the clock signal CLK in FIG. 1D). Then, in the period T5 of the clock signal CLK, the control signal SS6 of the switch S6 has a high voltage level again; thus, the switch S6 is ON again and the second low voltage level VGL is outputted as the second low level of the clock signal CLK again. Thus, the clock generator circuit 10 completes the clock signal CLK for driving the next row of pixel units 13. It is to be noted that because the display data of the image being displayed has the first polarity and has the charge sharing only with the capacitor C1, the switch S3 is not ON herein.

Figure 1E:
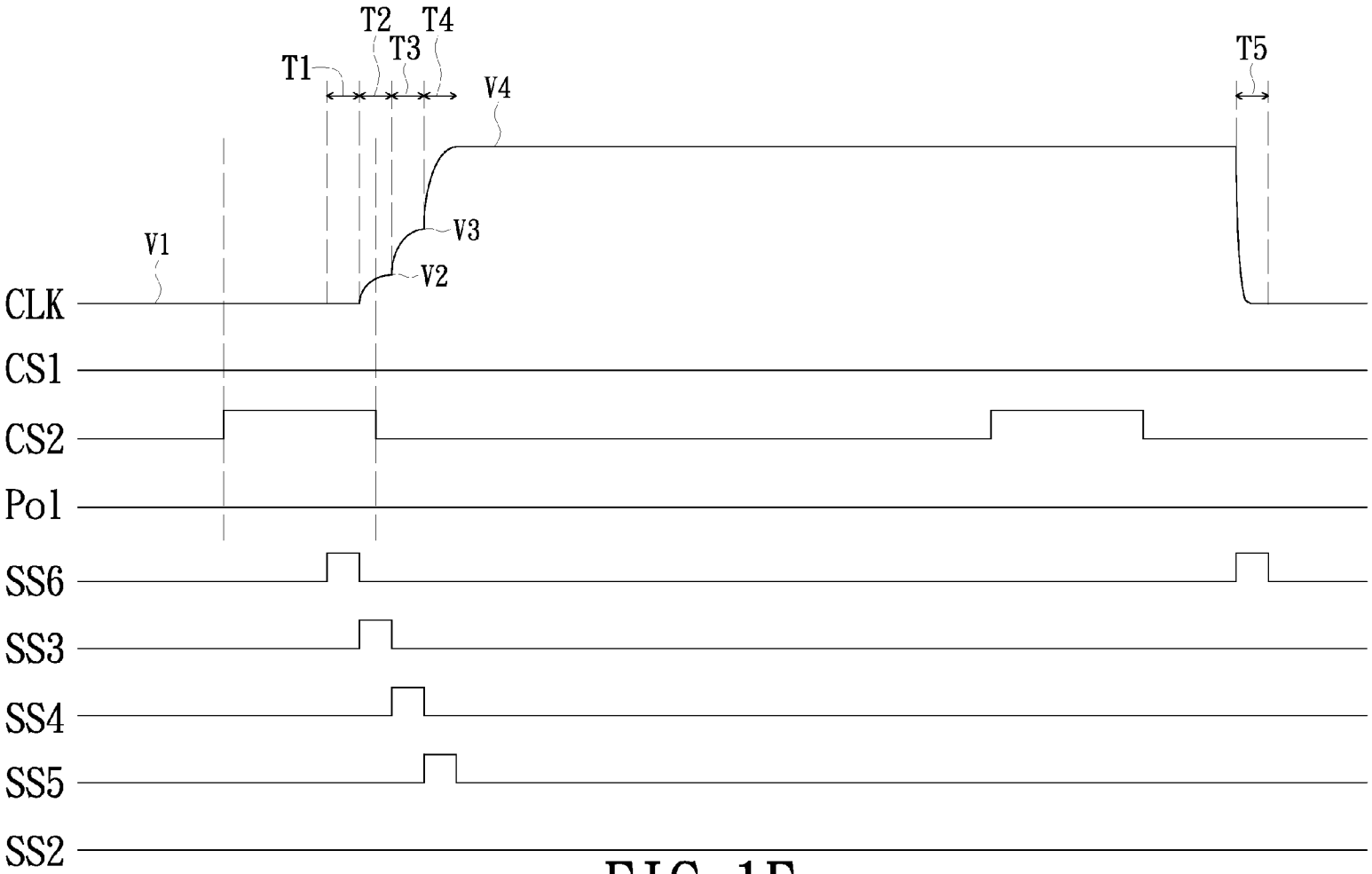
FIG. 1E is a timing chart of the related signals of the clock generator circuit in FIG. 1B.

Once the display of the first frame Frame1 in FIG. 1C is completed, the second frame Frame2 with second-polarity display data in FIG. 1C is to be displayed. The operation of the clock generator circuit 10 in FIG. 1B for displaying the second frame Frame2 in FIG. 1C in accordance with an embodiment of the present disclosure will be described as follow with a reference of FIG. 1E, which is a timing chart of the related signals of the clock generator circuit 10 in FIG. 1B. As shown, the signals in the timing chart of FIG. 1E include the polarity control signal Pol, the first control signal CS1, the second control signal CS2, the control signal SS2 for the switch S2, the control signal SS3 for the switch S3, the control signal SS4 for the switch S4, the control signal SS5 for the switch S5 and the control signal SS6 for the switch S6. Please refer to FIGS. 1B and 1E for a better understanding of the operation of the clock generator circuit 10 in FIG. 1B. In the present embodiment, the polarity control signal Pol has a low voltage level when the display data of the image being displayed has the second polarity. Specifically, when the second-polarity display data are received by the pixel units 13 through the data lines 121, the second control signal CS2 has a high voltage level thereby configuring the second end of each switch S7 to being electrically conductive with the output end of the charge sharing switch unit 11. Thus, the second-polarity voltage constituted by the plurality of second-polarity display data is outputted from the output end of the charge sharing switch unit 11. Meanwhile, because the polarity control signal Pol has a low voltage level, the second end of the switch S1 is switched to being electrically conductive with the first end of the capacitor C2 according to the low-level polarity control signal Pol. Thus, before the pixel units 13 performing the charge sharing, the second-polarity voltage can be stored into the capacitor C2.

In the period before the next row of pixel unit 13 are turned on and after the second-polarity voltage is stored in the capacitor C2, the clock generator circuit 10 in FIG. 1B is configured to perform the charge sharing through the switches S2, S3, S4, S5 and S6, thereby outputting the clock signal CLK for driving the next row of pixel unit 13. Specifically, in the period T1 of the clock signal CLK, the control signal SS6 of the switch S6 has a high voltage level; thus, the switch S6 is ON and the second low voltage level VGL is outputted as the second low level of the clock signal CLK (i.e., the level V1 of the clock signal CLK in FIG. 1E). Then, in the period T2 of the clock signal CLK, the control signal SS3 of the switch S3 has a high voltage level; thus, the switch S3 is ON and the second-polarity voltage stored in the capacitor C2 is outputted as the second level of the clock signal CLK (i.e., the level V2 of the clock signal CLK in FIG. 1E). Then, in the period T3 of the clock signal CLK, the control signal SS4 of the switch S4 has a high voltage level; thus, the switch S4 is ON and the first low voltage level GND is outputted as the first low level of the clock signal CLK (i.e., the level V3 of the clock signal CLK in FIG. 1E). Then, in the period T4 of the clock signal CLK, the control signal SS5 of the switch S5 has a high voltage level; thus, the switch S5 is ON and the high voltage level VGH is outputted as the high level of the clock signal CLK (i.e., the level V4 of the clock signal CLK in FIG. 1E). Then, in the period T5 of the clock signal CLK, the control signal SS6 of the switch S6 has a high voltage level again; thus, the switch S6 is ON again and the second low voltage level VGL is outputted as the second low level of the clock signal CLK again. Thus, the clock generator circuit 10 completes the clock signal CLK for driving the next row of pixel units 13. It is to be noted that because the display data of the image being displayed has the second polarity and has the charge sharing only with the capacitor C2, the switch S2 is not ON herein.

Figure 2A:
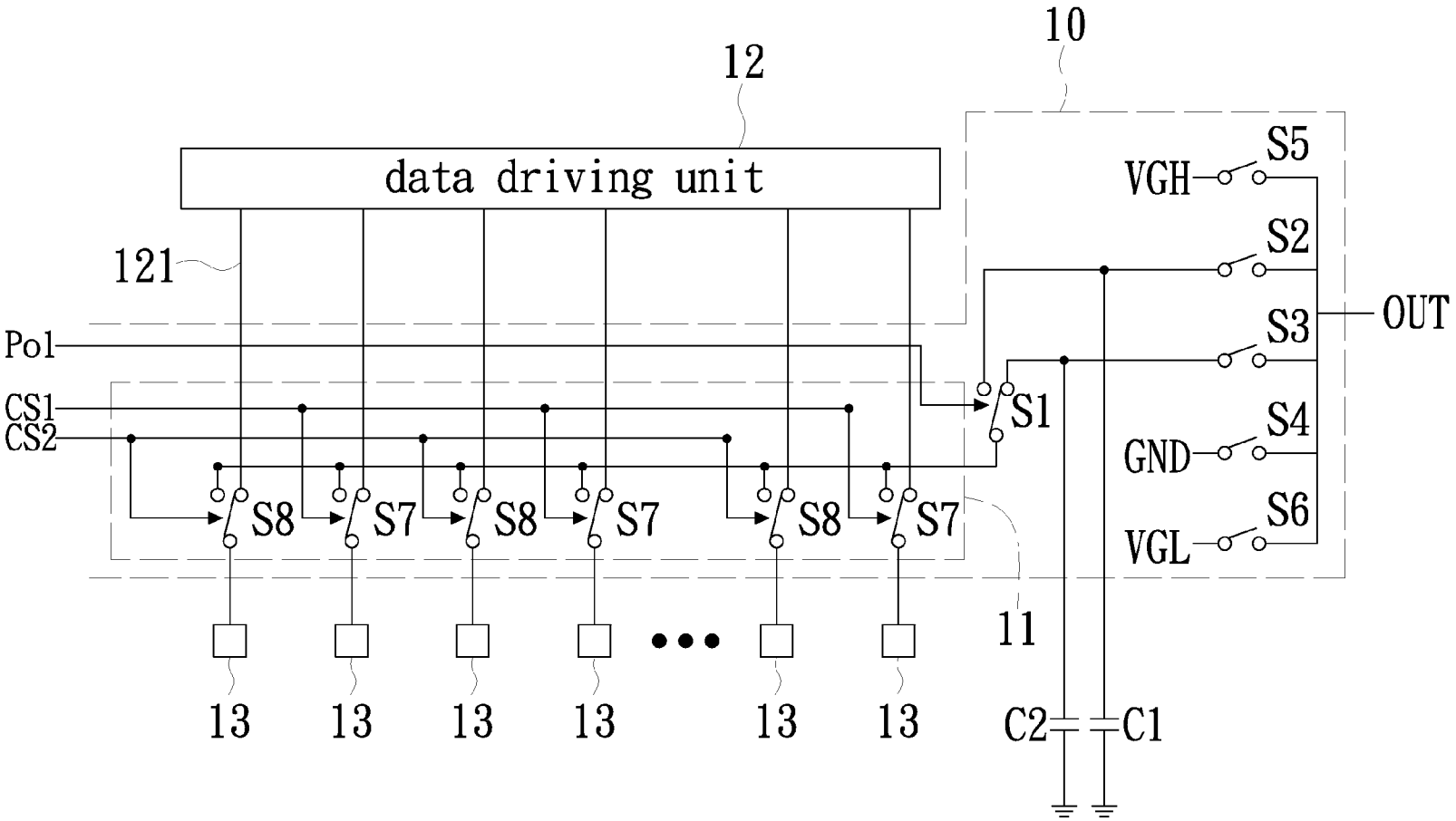
FIGS. 2A and 2B are schematic circuit block diagrams of a clock generator circuit of liquid crystal display panel in accordance with the second embodiment of the present disclosure.
Figure 2B:
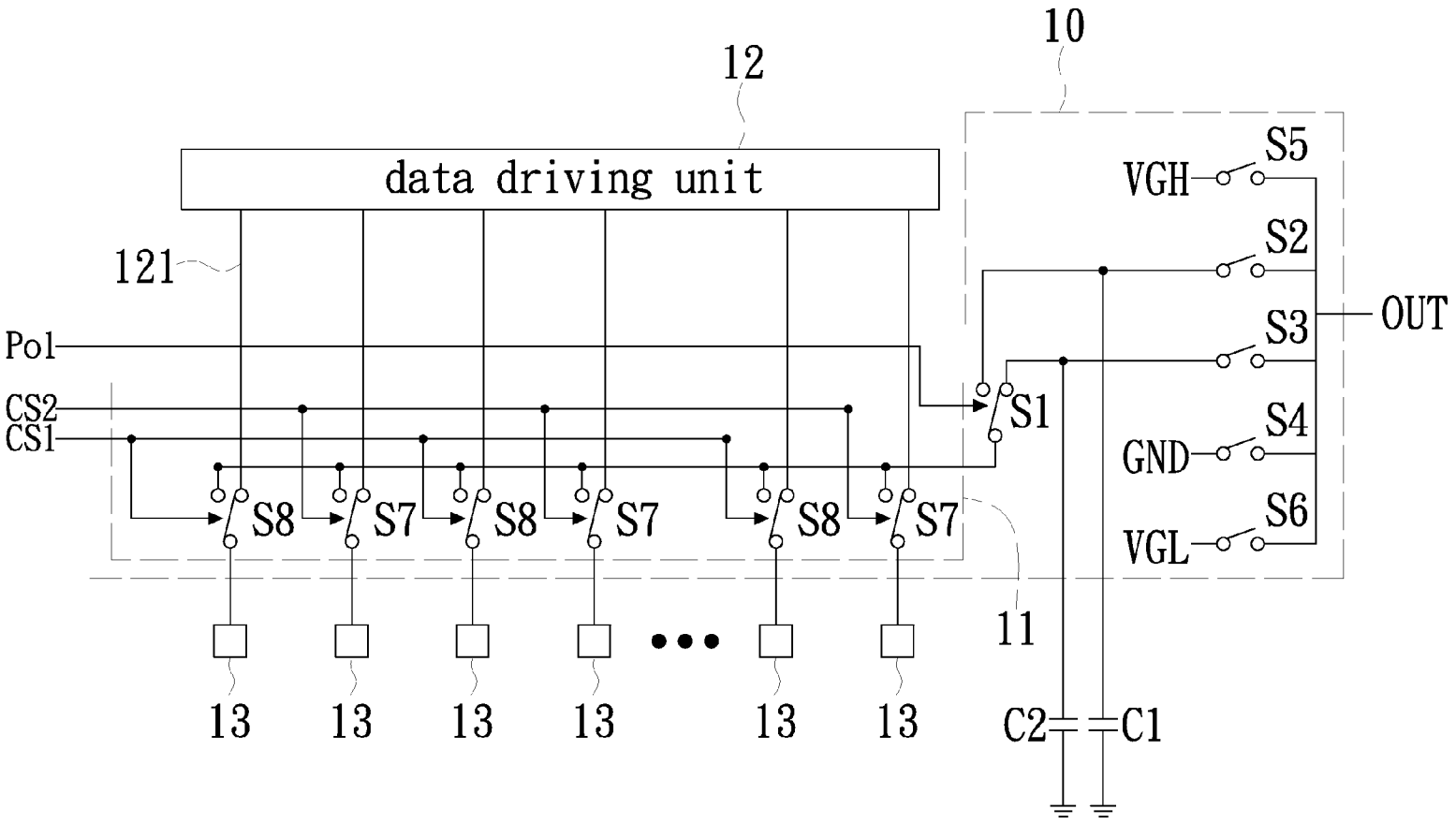
Figure 2C:
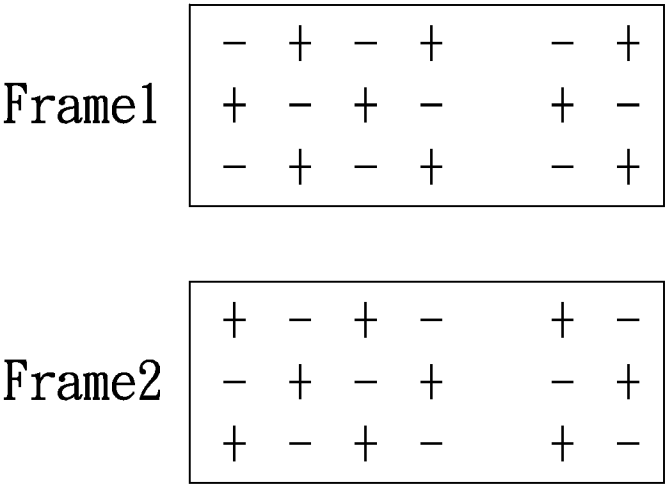
FIG. 2C is a schematic diagram illustrating the polarities of pixel units in dot inversion mode.

FIGS. 2A and 2B are schematic circuit block diagrams of a clock generator circuit of liquid crystal display panel in accordance with a second embodiment of the present disclosure. The clock generator circuit in FIGS. 2A and 2B is adapted to use with the pixel units 13 in dot inversion mode. In the dot inversion mode as illustrated in FIG. 2C, the display data of the adjacent two pixel units 13 have different polarities. For example, as illustrated in FIG. 1C, the display data of the adjacent two pixel units 13 in the first frame Frame1 and the second frame Frame2 have different polarities. In other words, each pixel unit 13 has different polarities in each successive two frames. The main difference between the embodiment of FIG. 2A and FIG. 1A is that the charge sharing switch unit 11 in FIG. 2A includes a plurality of switches S7 and a plurality of switches S8; wherein the switches S7 and S8 are interfaced according to the dot inversion mode. In addition, as described above, the display data of the adjacent two pixel units 13 in the same row have different polarities; thus, two control signals, such as the first control signal CS1 and the second control signal CS2 are used for configuring the clock generator circuit 10 in FIGS. 2A and 2B to perform the charge sharing.

Please refer to FIG. 2A again. In the present embodiment, the pixel units 13 in FIG. 2A herein are exemplarily for displaying the first row display data in the first frame Frame1 in FIG. 2C. Each switch S7 has a first end and a second end. In the present embodiment, the first end of each switch S7 is electrically coupled to the respective pixel unit 13; wherein the pixel units 13 electrically coupled to the switches S7 are used for receiving the first-polarity display data. Each switch S7 is configured to have its second end electrically coupled to either the output end of the charge sharing switch unit 11 or the respective data line 12 according to the first control signal CS1 received by the charge sharing switch unit 11. Each switch S8 has a first end and a second end. In the present embodiment, the first end of each switch S8 is electrically coupled to the respective pixel unit 13; wherein the pixel units 13 electrically coupled to the switches 8 are sued for receiving the second-polarity display data. Each switch S8 is configured to have its second end electrically coupled to either the output end of the charge sharing switch unit 11 or the respective data line 12 according to the second control signal CS2 received by the charge sharing switch unit 11. In one embodiment, the first polarity is positive polarity and the second polarity is negative polarity.

Figure 2D:
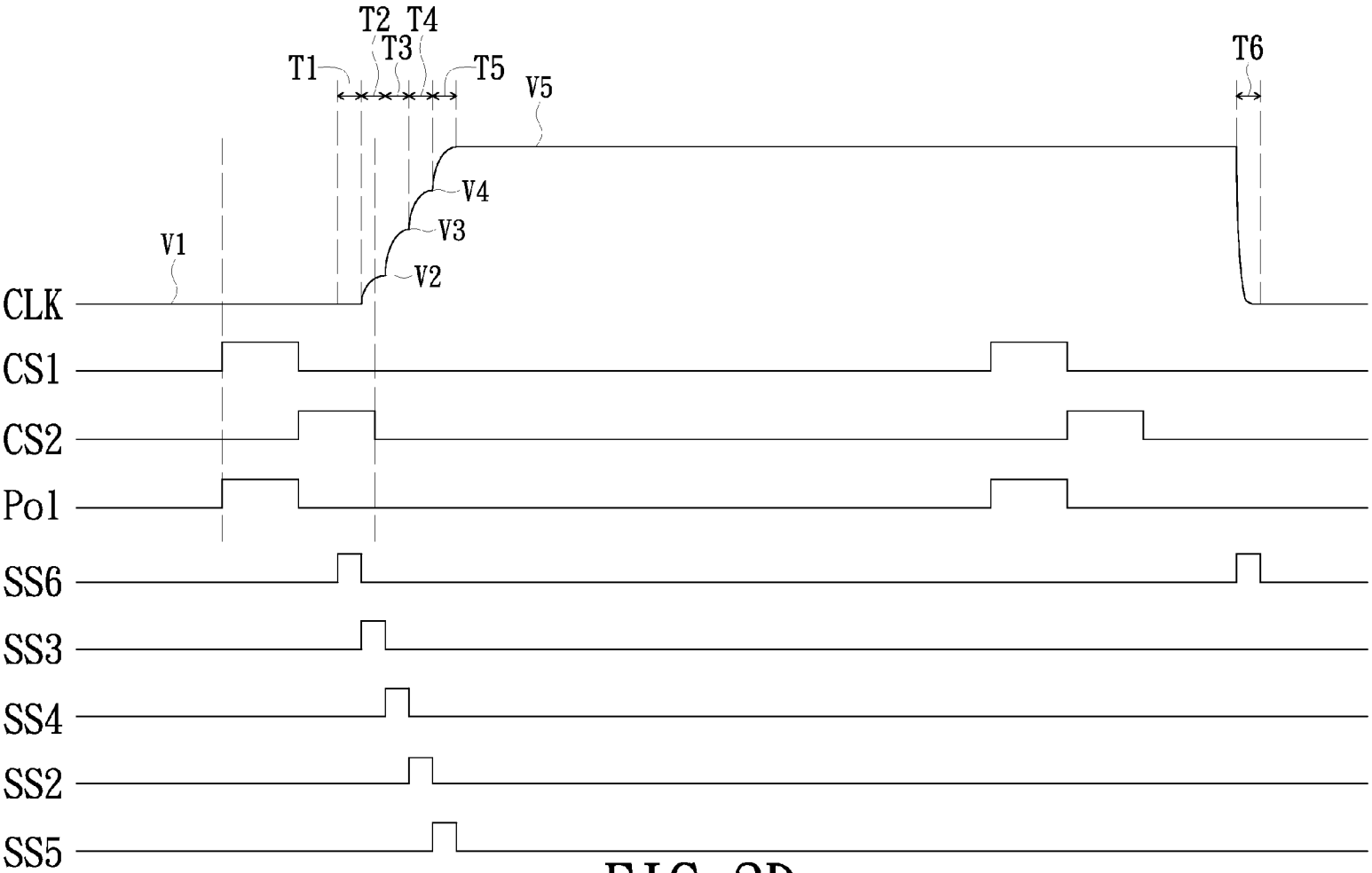
FIG. 2D is a timing chart of the related signals of the clock generator circuit in FIGS. 2A and 2B.

The operation of the clock generator circuit 10 in FIG. 2A in accordance with an embodiment of the present disclosure will be described as follow with a reference of FIG. 2D, which is a timing chart of the related signals of the clock generator circuit 10 in FIG. 2A. As shown, the signals in the timing chart of FIG. 2D include the polarity control signal Pol, the first control signal CS1, the second control signal CS2, the control signal SS2 for the switch S2, the control signal SS3 for the switch S3, the control signal SS4 for the switch S4, the control signal SS5 for the switch S5 and the control signal SS6 for the switch S6. Please refer to FIGS. 2A and 2D for a better understanding of the operation of the clock generator circuit 10 in FIG. 2A. When the first-polarity and second-polarity display data are received by the pixel units 13 through the data lines 121 and the first control signal CS1 has a high voltage level, the second end of each switch S7 is configured to switch to being electrically conductive with the output end of the charge sharing switch unit 11. Thus, the first-polarity voltage constituted by the plurality of first-polarity display data is outputted from the output end of the charge sharing switch unit 11. Meanwhile, because the polarity control signal Pol has a high voltage level, the second end of the switch S1 is switched to being electrically conductive with the first end of the capacitor C1 according to the high-level polarity control signal Pol. Thus, before the pixel units 13 performing the charge sharing, the first-polarity voltage can be stored into the capacitor C1.

Next, when the first-polarity and second-polarity display data are received by the pixel units 13 through the data lines 121 and the second control signal CS2 has a high voltage level, the second end of each switch S8 is configured to switch to being electrically conductive with the output end of the charge sharing switch unit 11. Thus, the second-polarity voltage constituted by the plurality of second-polarity display data is outputted from the output end of the charge sharing switch unit 11. Meanwhile, because the polarity control signal Pol has a low voltage level, the second end of the switch S1 is electrically conductive with the first end of the capacitor C2 according to the low-level polarity control signal Pol. Thus, before the pixel units 13 performing the charge sharing, the second-polarity voltage can be stored into the capacitor C2.

In the period before the next row of pixel unit 13 are turned on and after the voltages of the image being displayed are stored in the capacitors C1 and C2, the clock generator circuit 10 in FIG. 2A is configured to perform the charge sharing through the switches S2, S3, S4, S5 and S6, thereby outputting the clock signal CLK for driving the next row of pixel unit 13. Specifically, in the period T1 of the clock signal CLK, the control signal SS6 of the switch S6 has a high voltage level; thus, the switch S6 is ON and the second low voltage level VGL is outputted as the second low level of the clock signal CLK (i.e., the level V1 of the clock signal CLK in FIG. 2D). Then, in the period T2 of the clock signal CLK, the control signal SS3 of the switch S3 has a high voltage level; thus, the switch S3 is ON and the second-polarity voltage stored in the capacitor C2 is outputted as the second level of the clock signal CLK (i.e., the level V2 of the clock signal CLK in FIG. 2D). Then, in the period T3 of the clock signal CLK, the control signal SS4 of the switch S4 has a high voltage level; thus, the switch S4 is ON and the first low voltage level GND is outputted as the first low level of the clock signal CLK (i.e., the level V3 of the clock signal CLK in FIG. 2D). Then, in the period T4 of the clock signal CLK, the control signal SS2 of the switch S2 has a high voltage level; thus, the switch S2 is ON and the first-polarity voltage stored in the capacitor C1 is outputted as the first level of the clock signal CLK (i.e., the level V4 of the clock signal CLK in FIG. 2D). Then, in the period T5 of the clock signal CLK, the control signal SS5 of the switch S5 has a high voltage level; thus, the switch S5 is ON and the high voltage level VGH is outputted as the high level of the clock signal CLK (i.e., the level V5 of the clock signal CLK in FIG. 2D). Then, in the period T6 of the clock signal CLK, the control signal SS6 of the switch S6 has a high voltage level again; thus, the switch S6 is ON again and the second low voltage level VGL is outputted as the second low level of the clock signal CLK again. Thus, the clock generator circuit 10 completes the clock signal CLK for driving the next row of pixel units 13.

Then, please refer to FIG. 2B. As shown, the circuit of FIG. 2B is going to drive the next row of pixel units 13 in the dot inversion mode. In other words, in the present embodiment the pixel units 13 in FIG. 2B herein are exemplarily for displaying the second row display data in the first frame Frame1 in FIG. 2C.

The main difference between the embodiment of FIG. 2A and FIG. 2B is that the pixel units 13 electrically coupled to the switches S7 in FIG. 2B are used for receiving the second-polarity display data. In the present embodiment, each switch S7 is configured to have its second end electrically coupled to either the output end of the charge sharing switch unit 11 or the respective data line 12 according to the second control signal CS2 received by the charge sharing switch unit 11. In the present embodiment, the first end of each switch S8 is electrically coupled to the respective pixel unit 13; wherein the pixel units 13 electrically coupled to the switches 8 are sued for receiving the first-polarity display data. Each switch S8 is configured to have its second end electrically coupled to either the output end of the charge sharing switch unit 11 or the respective data line 12 according to the first control signal CS1 received by the charge sharing switch unit 11. In one embodiment, the first polarity is positive polarity and the second polarity is negative polarity.

The operation of the clock generator circuit 10 in FIG. 2B in accordance with an embodiment of the present disclosure will be described as follow with a reference of FIG. 2D. Please refer to FIGS. 2B and 2D for a better understanding of the operation of the clock generator circuit 10 in FIG. 2B. When the first-polarity and second-polarity display data are received by the pixel units 13 through the data lines 121 and the first control signal CS1 has a high voltage level, the second end of each switch S8 is configured to switch to being electrically conductive with the output end of the charge sharing switch unit 11 according to the high-level first control signal CS1. Thus, the first-polarity voltage constituted by the plurality of first-polarity display data is outputted from the output end of the charge sharing switch unit 11. Meanwhile, because the polarity control signal Pol has a high voltage level, the second end of the switch S1 is switched to being electrically conductive with the first end of the capacitor C1 according to the high-level polarity control signal Pol. Thus, before the pixel units 13 performing the charge sharing, the first-polarity voltage can be stored into the capacitor C1.

Next, when the first-polarity and second-polarity display data are received by the pixel units 13 through the data lines 121 and the second control signal CS2 has a high voltage level, the second end of each switch S7 is configured to switch to being electrically conductive with the output end of the charge sharing switch unit 11. Thus, the second-polarity voltage constituted by the plurality of second-polarity display data is outputted from the output end of the charge sharing switch unit 11. Meanwhile, because the polarity control signal Pol has a high voltage level, the second end of the switch S1 is electrically conductive with the first end of the capacitor C2 according to the high-level polarity control signal Pol. Thus, before the pixel units 13 performing the charge sharing, the second-polarity voltage can be stored into the capacitor C2.

In the period before the next row of pixel unit 13 are turned on and after the voltages of the image being displayed are stored in the capacitors C1 and C2, the clock generator circuit 10 in FIG. 2B is configured to perform the charge sharing through the switches S2, S3, S4, S5 and S6, thereby outputting the clock signal CLK for driving the next row of pixel unit 13. Specifically, in the period T1 of the clock signal CLK, the control signal SS6 of the switch S6 has a high voltage level; thus, the switch S6 is ON and the second low voltage level VGL is outputted as the second low level of the clock signal CLK (i.e., the level V1 of the clock signal CLK in FIG. 2D). Then, in the period T2 of the clock signal CLK, the control signal SS3 of the switch S3 has a high voltage level; thus, the switch S3 is ON and the second-polarity voltage stored in the capacitor C2 is outputted as the second level of the clock signal CLK (i.e., the level V2 of the clock signal CLK in FIG. 2D). Then, in the period T3 of the clock signal CLK, the control signal SS4 of the switch S4 has a high voltage level; thus, the switch S4 is ON and the first low voltage level GND is outputted as the first low level of the clock signal CLK (i.e., the level V3 of the clock signal CLK in FIG. 2D). Then, in the period T4 of the clock signal CLK, the control signal SS2 of the switch S2 has a high voltage level; thus, the switch S2 is ON and the first-polarity voltage stored in the capacitor C1 is outputted as the first level of the clock signal CLK (i.e., the level V4 of the clock signal CLK in FIG. 2D). Then, in the period T5 of the clock signal CLK, the control signal SS5 of the switch S5 has a high voltage level; thus, the switch S5 is ON and the high voltage level VGH is outputted as the high level of the clock signal CLK (i.e., the level V5 of the clock signal CLK in FIG. 2D). Then, in the period T6 of the clock signal CLK, the control signal SS6 of the switch S6 has a high voltage level again; thus, the switch S6 is ON again and the second low voltage level VGL is outputted as the second low level of the clock signal CLK again. Thus, the clock generator circuit 10 in this embodiment completes the clock signal CLK for driving the next row of pixel units 13.

Figure 3A:
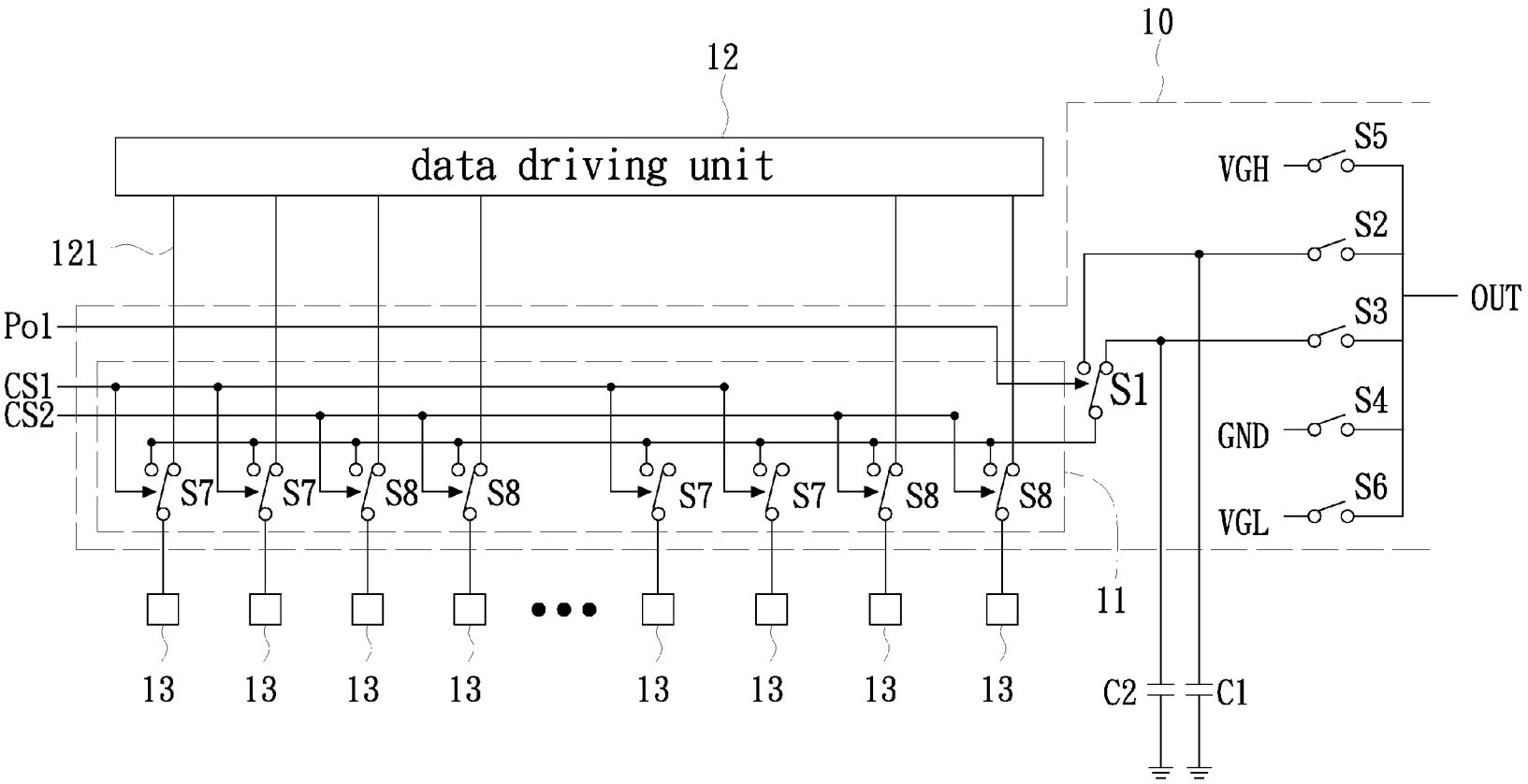
FIGS. 3A and 3B are schematic circuit block diagrams of a clock generator circuit of liquid crystal display panel in accordance with the third embodiment of the present disclosure.
Figure 3B:
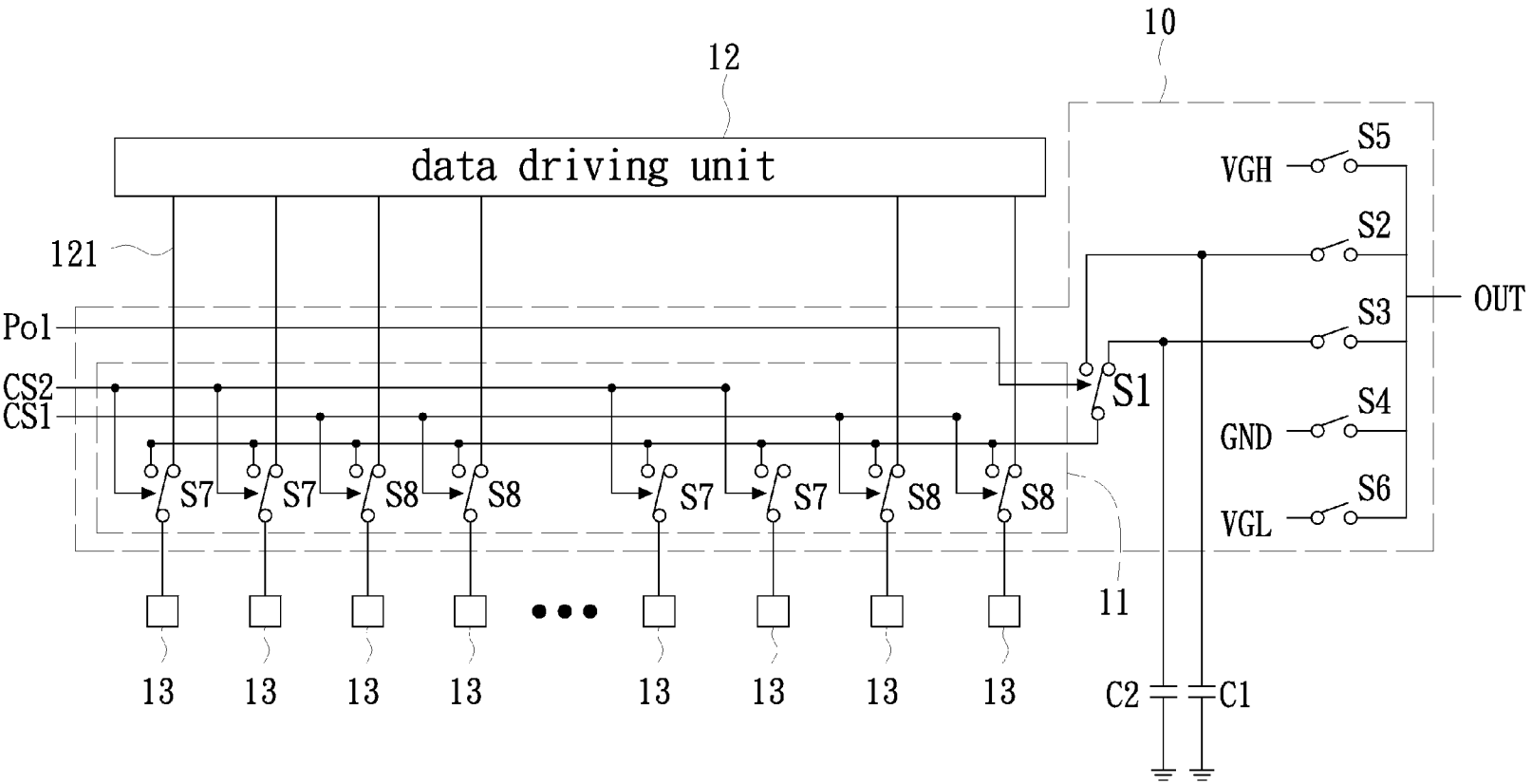

FIGS. 3A and 3B are schematic circuit block diagrams of a clock generator circuit of liquid crystal display panel in accordance with a third embodiment of the present disclosure. The clock generator circuit in FIGS. 3A and 3B is adapted to use with the pixel units 13 in column inversion mode. In the column inversion mode as illustrated in FIG. 3C, every adjacent two columns of pixel units 13 is referred to as one group. Specifically, the display data of the pixel units 13 in the same row and in the same group have the same polarity; the display data of the pixel units 13 at the same position in the adjacent two groups have the different polarities; and the display data of the pixel unit 13 at the same position in the adjacent two groups have the different polarities. The main difference between the embodiment of FIG. 3A and FIG. 1A is that the charge sharing switch unit 11 in FIG. 3A includes a plurality of switches S7 and a plurality of switches S8; wherein every two switches S7 and every two switches S8 are interfaced according to the column inversion mode. In addition, as described above, the display data of the pixel units 13 in the same row have two polarities; thus, two control signals, such as the first control signal CS1 and the second control signal CS2 are used for configuring the clock generator circuit 10 in FIGS. 3A and 3B to perform the charge sharing.

Please refer to FIG. 3A again. In the present embodiment, the pixel units 13 in FIG. 3A herein are exemplarily for displaying the first row display data in the first frame Frame1 in FIG. 3C. Each switch S7 has a first end and a second end. In the present embodiment, the first end of each switch S7 is electrically coupled to the respective pixel unit 13; wherein the pixel units 13 electrically coupled to the switches S7 are used for receiving the first-polarity display data. Each switch S7 is configured to have its second end electrically coupled to either the output end of the charge sharing switch unit 11 or the respective data line 12 according to the first control signal CS1 received by the charge sharing switch unit 11, thereby outputting the first-polarity voltage constituted by the first-polarity display data. Each switch S8 has a first end and a second end. In the present embodiment, the first end of each switch S8 is electrically coupled to the respective pixel unit 13; wherein the pixel units 13 electrically coupled to the switches 8 are sued for receiving the second-polarity display data. Each switch S8 is configured to have its second end electrically coupled to either the output end of the charge sharing switch unit 11 or the respective data line 12 according to the second control signal CS2 received by the charge sharing switch unit 11, thereby outputting the second-polarity voltage constituted by the second-polarity display data. In one embodiment, the first polarity is positive polarity and the second polarity is negative polarity.

Figure 3D:
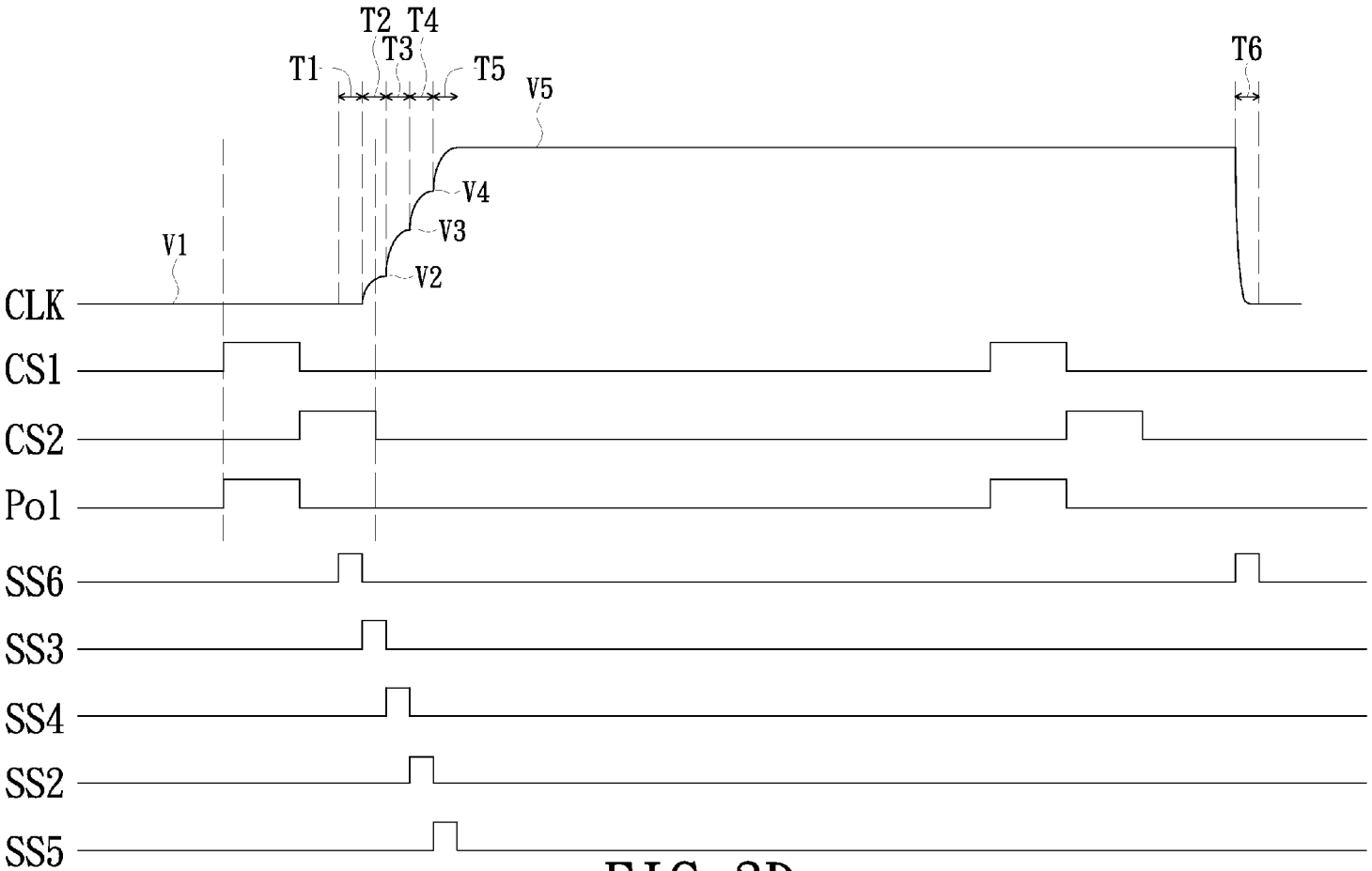
FIG. 3D is a timing chart of the related signals of the clock generator circuit in FIGS. 3A and 3B.

The operation of the clock generator circuit 10 in FIG. 3A in accordance with an embodiment of the present disclosure will be described as follow with a reference of FIG. 3D, which is a timing chart of the related signals of the clock generator circuit 10 in FIG. 3A. As shown, the signals in the timing chart of FIG. 3D include the polarity control signal Pol, the first control signal CS1, the second control signal CS2, the control signal SS2 for the switch S2, the control signal SS3 for the switch S3, the control signal SS4 for the switch S4, the control signal SS5 for the switch S5 and the control signal SS6 for the switch S6. Please refer to FIGS. 3A and 3D for a better understanding of the operation of the clock generator circuit 10 in FIG. 3A. When the first-polarity and second-polarity display data are received by the pixel units 13 through the data lines 121 and the first control signal CS1 has a high voltage level, the second end of each switch S7 is configured to switch to being electrically conductive with the output end of the charge sharing switch unit 11. Thus, the first-polarity voltage constituted by the plurality of first-polarity display data is outputted from the output end of the charge sharing switch unit 11. Meanwhile, because the polarity control signal Pol has a high voltage level, the second end of the switch S1 is switched to being electrically conductive with the first end of the capacitor C1 according to the high-level polarity control signal Pol. Thus, before the pixel units 13 performing the charge sharing, the first-polarity voltage can be stored into the capacitor C1.

Next, when the first-polarity and second-polarity display data are received by the pixel units 13 through the data lines 121 and the second control signal CS2 has a high voltage level, the second end of each switch S8 is configured to switch to being electrically conductive with the output end of the charge sharing switch unit 11. Thus, the second-polarity voltage constituted by the plurality of second-polarity display data is outputted from the output end of the charge sharing switch unit 11. Meanwhile, because the polarity control signal Pol has a low voltage level, the second end of the switch S1 is electrically conductive with the first end of the capacitor C2 according to the low-level polarity control signal Pol. Thus, before the pixel units 13 performing the charge sharing, the second-polarity voltage can be stored into the capacitor C2.

In the period before the next row of pixel unit 13 are turned on and after the voltages of the image being displayed are stored in the capacitors C1 and C2, the clock generator circuit 10 in FIG. 3A is configured to perform the charge sharing through the switches S2, S3, S4, S5 and S6, thereby outputting the clock signal CLK for driving the next row of pixel unit 13. Specifically, in the period T1 of the clock signal CLK, the control signal SS6 of the switch S6 has a high voltage level; thus, the switch S6 is ON and the second low voltage level VGL is outputted as the second low level of the clock signal CLK (i.e., the level V1 of the clock signal CLK in FIG. 3D). Then, in the period T2 of the clock signal CLK, the control signal SS3 of the switch S3 has a high voltage level; thus, the switch S3 is ON and the second-polarity voltage stored in the capacitor C2 is outputted as the second level of the clock signal CLK (i.e., the level V2 of the clock signal CLK in FIG. 3D). Then, in the period T3 of the clock signal CLK, the control signal SS4 of the switch S4 has a high voltage level; thus, the switch S4 is ON and the first low voltage level GND is outputted as the first low level of the clock signal CLK (i.e., the level V3 of the clock signal CLK in FIG. 3D). Then, in the period T4 of the clock signal CLK, the control signal SS2 of the switch S2 has a high voltage level; thus, the switch S2 is ON and the first-polarity voltage stored in the capacitor C1 is outputted as the first level of the clock signal CLK (i.e., the level V4 of the clock signal CLK in FIG. 3D). Then, in the period T5 of the clock signal CLK, the control signal SS5 of the switch S5 has a high voltage level; thus, the switch S5 is ON and the high voltage level VGH is outputted as the high level of the clock signal CLK (i.e., the level V5 of the clock signal CLK in FIG. 3D). Then, in the period T6 of the clock signal CLK, the control signal SS6 of the switch S6 has a high voltage level again; thus, the switch S6 is ON again and the second low voltage level VGL is outputted as the second low level of the clock signal CLK again. Thus, the clock generator circuit 10 completes the clock signal CLK for driving the next row of pixel units 13.

Then, please refer to FIG. 3B. As shown, the circuit of FIG. 3B is going to drive the next row of pixel units 13 in the column inversion mode. In other words, in the present embodiment the pixel units 13 in FIG. 3B herein are exemplarily for displaying the second row display data in the first frame Frame1 in FIG. 3C.

The main difference between the embodiment of FIG. 3A and FIG. 3B is that the pixel units 13 electrically coupled to the switches S7 in FIG. 3B are used for receiving the second-polarity display data. In the present embodiment, each switch S7 is configured to have its second end electrically coupled to either the output end of the charge sharing switch unit 11 or the respective data line 121 according to the second control signal CS2 received by the charge sharing switch unit 11. In the present embodiment, the first end of each switch S8 is electrically coupled to the respective pixel unit 13; wherein the pixel units 13 electrically coupled to the switches 8 are sued for receiving the first-polarity display data. Each switch S8 is configured to have its second end electrically coupled to either the output end of the charge sharing switch unit 11 or the respective data line 121 according to the first control signal CS1 received by the charge sharing switch unit 11. In one embodiment, the first polarity is positive and the second polarity is negative.

The operation of the clock generator circuit 10 in FIG. 3B in accordance with an embodiment of the present disclosure will be described as follow with a reference of FIG. 3D. Please refer to FIGS. 3B and 3D for a better understanding of the operation of the clock generator circuit 10 in FIG. 3B. When the first-polarity and second-polarity display data are received by the pixel units 13 through the data lines 121 and the first control signal CS1 has a high voltage level, the second end of each switch S8 is configured to switch to being electrically conductive with the output end of the charge sharing switch unit 11 according to the high-level first control signal CS1. Thus, the first-polarity voltage constituted by the plurality of first-polarity display data is outputted from the output end of the charge sharing switch unit 11. Meanwhile, because the polarity control signal Pol has a high voltage level, the second end of the switch S1 is switched to being electrically conductive with the first end of the capacitor C1 according to the high-level polarity control signal Pol. Thus, before the pixel units 13 performing the charge sharing, the first-polarity voltage can be stored into the capacitor C1.

Next, when the first-polarity and second-polarity display data are received by the pixel units 13 through the data lines 121 and the second control signal CS2 has a high voltage level, the second end of each switch S7 is configured to switch to being electrically conductive with the output end of the charge sharing switch unit 11. Thus, the second-polarity voltage constituted by the plurality of second-polarity display data is outputted from the output end of the charge sharing switch unit 11. Meanwhile, because the polarity control signal Pol has a low voltage level, the second end of the switch S1 is electrically conductive with the first end of the capacitor C2 according to the low-level polarity control signal Pol. Thus, before the pixel units 13 performing the charge sharing, the second-polarity voltage can be stored into the capacitor C2.

In the period before the next row of pixel unit 13 are turned on and after the voltages of the image being displayed are stored in the capacitors C1 and C2, the clock generator circuit 10 in FIG. 3B is configured to perform the charge sharing through the switches S2, S3, S4, S5 and S6, thereby outputting the clock signal CLK for driving the next row of pixel unit 13. Specifically, in the period T1 of the clock signal CLK, the control signal SS6 of the switch S6 has a high voltage level; thus, the switch S6 is ON and the second low voltage level VGL is outputted as the second low level of the clock signal CLK (i.e., the level V1 of the clock signal CLK in FIG. 3D). Then, in the period T2 of the clock signal CLK, the control signal SS3 of the switch S3 has a high voltage level; thus, the switch S3 is ON and the second-polarity voltage stored in the capacitor C2 is outputted as the second level of the clock signal CLK (i.e., the level V2 of the clock signal CLK in FIG. 3D). Then, in the period T3 of the clock signal CLK, the control signal SS4 of the switch S4 has a high voltage level; thus, the switch S4 is ON and the first low voltage level GND is outputted as the first low level of the clock signal CLK (i.e., the level V3 of the clock signal CLK in FIG. 3D). Then, in the period T4 of the clock signal CLK, the control signal SS2 of the switch S2 has a high voltage level; thus, the switch S2 is ON and the first-polarity voltage stored in the capacitor C1 is outputted as the first level of the clock signal CLK (i.e., the level V4 of the clock signal CLK in FIG. 3D). Then, in the period T5 of the clock signal CLK, the control signal SS5 of the switch S5 has a high voltage level; thus, the switch S5 is ON and the high voltage level VGH is outputted as the high level of the clock signal CLK (i.e., the level V5 of the clock signal CLK in FIG. 3D). Then, in the period T6 of the clock signal CLK, the control signal SS6 of the switch S6 has a high voltage level again; thus, the switch S6 is ON again and the second low voltage level VGL is outputted as the second low level of the clock signal CLK again. Thus, the clock generator circuit 10 in this embodiment completes the clock signal CLK for driving the next row of pixel units 13.

According to the description of the clock generator circuit of liquid crystal display panel in the above embodiments, an operation method of clock generator circuit of liquid crystal display panel is developed as follow.

Figure 4:
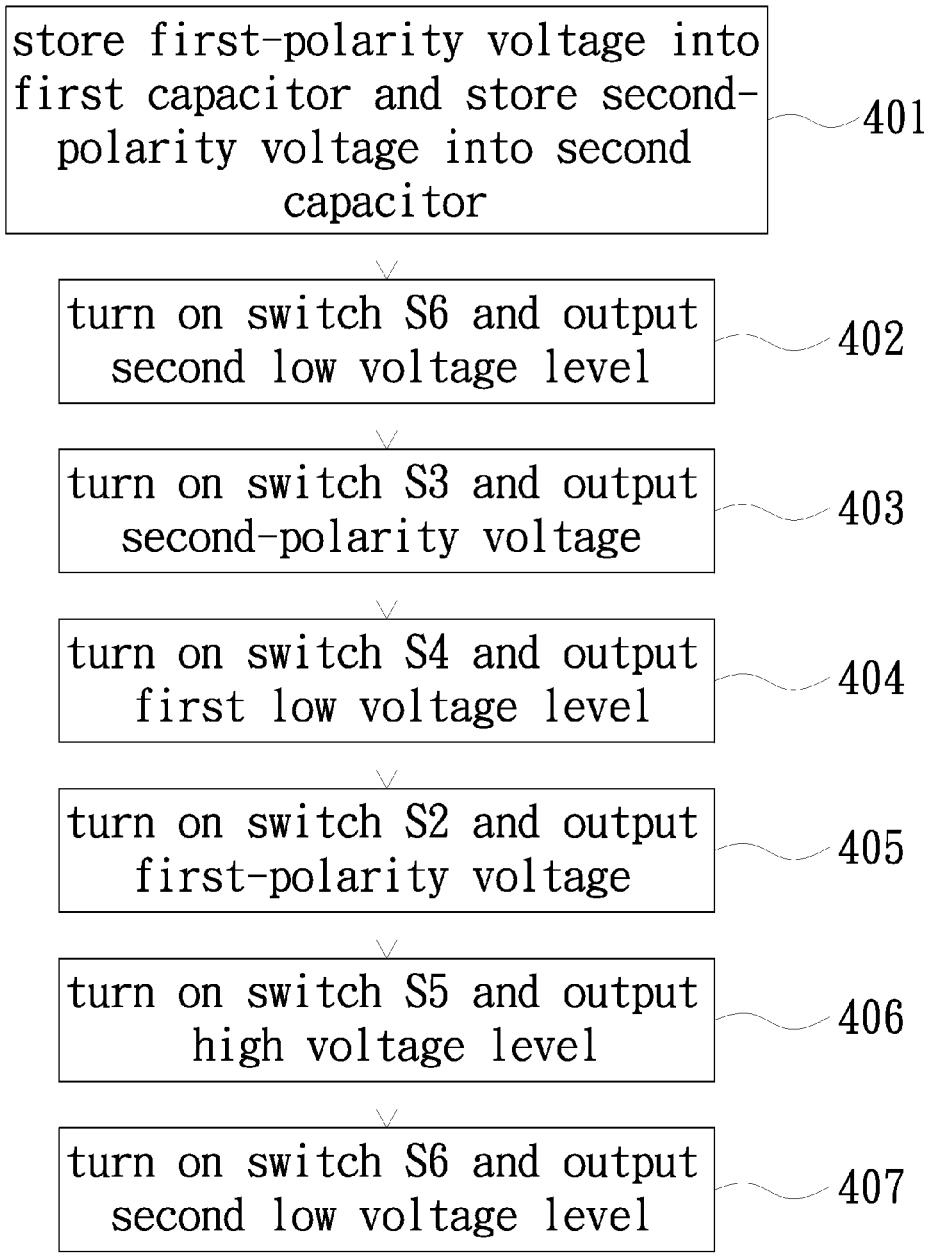
FIG. 4 is a flow char of an operation method of clock generator circuit of liquid crystal display panel in accordance with an embodiment of the present disclosure.

FIG. 4 is a flow char of an operation method of clock generator circuit of liquid crystal display panel in accordance with an embodiment of the present disclosure. As shown in FIG. 4, the operation method includes: storing the first-polarity voltage into the first capacitor and storing the second-polarity voltage into the second capacitor before the next row of pixel units 13 are turned on and the display data of the image being displayed is performed on the charge sharing (step 401); turning on the switch S6 and outputting, through the output end OUT of the clock generator circuit, the second low voltage level VGL as the second low level of the clock signal CLK (step 402); turning on the switch S3 and outputting, through the output end OUT of the clock generator circuit, the second-polarity voltage as the second level of the clock signal CLK (step 403); turning on the switch S4 and outputting, through the output end OUT of the clock generator circuit, the first low voltage level GND as the first low level of the clock signal CLK (step 404); turning on the switch S2 and outputting, through the output end OUT of the clock generator circuit, the first-polarity voltage as the first level of the clock signal CLK (step 405); turning on the switch S5 and outputting, through the output end OUT of the clock generator circuit, the high voltage level VGH as the high level of the clock signal CLK (step 406); and turning on the switch S6 again and outputting, through the output end OUT of the clock generator circuit, the second low voltage level VGL as the second low level of the clock signal CLK again, thereby completing the clock signal CLK for driving the next row of pixel units 13 (step 407).

In summary, according to the aforementioned description, it is understood that the clock generator circuit of liquid crystal display panel disclosed in the present invention is adapted to the some specific driving means, such as dot inversion, frame inversion column inversion (i.e., two column inversion), of pixel units. In addition, by using the voltages of the display data for transmitted to the pixel units to perform the charge sharing, the clock generator circuit of the present invention can significantly reduce the voltage required for the clock signals thereby achieving the power saving effect.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A clock generator circuit of a liquid crystal display panel, comprising:

a charge sharing switch unit, having an output end, the charge sharing switch unit being electrically coupled between a plurality of data lines and a plurality of pixel units, the charge sharing switch unit being configured to receive a first control signal and output, through the output end thereof, a first-polarity voltage according to the first control signal, wherein the first-polarity voltage is constituted by voltages of a plurality of first-polarity display data transmitted on the data lines;

a first capacitor, having a first end and a second end, the first end of the first capacitor being electrically coupled to the output end of the charge sharing switch unit and the second end of the first capacitor being electrically coupled to a first low voltage level;

a first switch, having a first end and a second end, the first end of the first switch being electrically coupled to the first end of the first capacitor and the second end of the first switch being electrically coupled to an output end of the clock generator circuit;

a second switch, having a first end and a second end, the first end of the second switch being electrically coupled to a high voltage level and the second end of the second switch being electrically coupled to the output end of the clock generator circuit;

a third switch, having a first end and a second end, the first end of the third switch being electrically coupled to the first low voltage level and the second end of the third switch being electrically coupled to the output end of the clock generator circuit; and a fourth switch, having a first end and a second end, the first end of the fourth switch being electrically coupled to a second low voltage level and the second end of the fourth switch being electrically coupled to the output end of the clock generator circuit, wherein, the output end of the clock generator circuit is used to output a clock signal.

2. The clock generator circuit according to claim 1, wherein the charge sharing switch unit comprises a plurality of fifth switches, each fifth switch has a first end and a second end, the first end of each fifth switch is electrically coupled to one of the pixel units, each fifth switch is configured to have its second end electrically coupled to either the output end of the charge sharing switch unit or one of the data lines according to the first control signal.

3. The clock generator circuit according to claim 1, further comprising:

a sixth switch, having a first end and a second end, the second end of the sixth switch being electrically coupled to the output end of the clock generator circuit;

a second capacitor, having a first end and a second end, the first end of the second capacitor being electrically coupled to the first end of the sixth switch and the second end of the second capacitor being electrically coupled to the first low voltage level; and a seventh switch, electrically coupled between the first end of the first capacitor and the output end of the charge sharing switch unit, the seventh switch having a first end and a second end, the first end of the seventh switch being electrically coupled to the output end of the charge sharing switch unit, the seventh switch being configured to have its second end electrically coupled to either the first end of the first capacitor or the first end of the second capacitor according to a polarity control signal.

4. The clock generator circuit according to claim 3, wherein the charge sharing switch unit is further configured to receive a second control signal and output, through the output end thereof, a second-polarity voltage according to the second control signal, the second-polarity voltage is constituted by voltages of a plurality of second-polarity display data transmitted on the data lines.

5. The clock generator circuit according to claim 4, wherein the charge sharing switch unit further comprises a plurality of eighth switches and a plurality of ninth switches, the eighth switches are electrically coupled to the data lines having the first-polarity display data, the ninth switches are electrically coupled to the data lines having the second-polarity display data, each eighth switch has a first end and a second end, the first end of each eighth switch is electrically coupled to one of the pixel units, each eighth switch is configured to have its second end electrically coupled to either the output end of the charge sharing switch unit or one of the data lines according to the first control signal, each ninth switch has a first end and a second end, the first end of each ninth switch is electrically coupled to one of the pixel units, each ninth switch is configured to have its second end electrically coupled to either the output end of the charge sharing switch unit or one of the data lines according to the second control signal.

6. An operation method of a clock generator circuit of a liquid crystal display panel, the clock generator circuit comprising a charge sharing switch unit, a first capacitor, a first switch, a second switch, a third switch and a fourth switch, the charge sharing switch unit being electrically coupled between a plurality of data lines and a plurality of pixel units, the charge sharing switch unit being configured to output a first-polarity voltage through an output end of the charge sharing switch unit, the first-polarity voltage being constituted by voltages of a plurality of first-polarity display data transmitted on the data lines, a first end of the first capacitor being electrically coupled to the output end of the charge sharing switch unit, the first switch being electrically coupled between a first low voltage level and an output end of the clock generator circuit, the second switch being electrically coupled between a second low voltage level and the output end of the clock generator circuit, the third switch being electrically coupled between the first end of the first capacitor and the output end of the clock generator circuit, the fourth switch being electrically coupled between a high voltage level and the output end of the clock generator circuit, the operation method comprising:

storing the first-polarity voltage into the first capacitor;

turning on the first switch and outputting the first low voltage level to the output end of the clock generator circuit;

turning on the second switch and outputting the second low voltage level to the output end of the clock generator circuit;

turning on the fourth switch and outputting the high voltage level to the output end of the clock generator circuit; and turning on the first switch and outputting the first low voltage level to the output end of the clock generator circuit;

wherein the third switch is turned on to output the first-polarity voltage stored in the first capacitor to the output end of the clock generator circuit after the first switch is turned on and before the second switch is turned on, or, after the second switch is turned on and before the fourth switch is turned on.

7. The operation method according to claim 6, wherein the first polarity is positive, and the third switch is turned on to output the first-polarity voltage stored in the first capacitor to the output end of the clock generator circuit after the second switch is turned on and before the fourth switch is turned on.

8. The operation method according to claim 6, wherein the first polarity is negative, and the third switch is turned on to output the first-polarity voltage stored in the first capacitor to the output end of the clock generator circuit after the first switch is turned on and before the second switch is turned on.

* * * * *